United States Patent [19]

Ong et al.

[11] Patent Number: 4,474,865

[45] Date of Patent: Oct. 2, 1984

[54] LAYERED PHOTORESPONSIVE DEVICES

[75] Inventors: Beng S. Ong, Mississauga; Barkev Keoshkerian, Willowdale; Thomas B. McAneney, Burlington, all of Canada

[73] Assignee: Xerox Corporation, Stamford, Conn.

[21] Appl. No.: 521,198

[22] Filed: Aug. 8, 1983

[51] Int. Cl.[3] ..... G03G 5/10

[52] U.S. Cl. ..... 430/58; 430/59

[58] Field of Search ..... 430/78, 83, 58, 59

[56] References Cited

U.S. PATENT DOCUMENTS

| | | | |
|---|---|---|---|
| 3,169,060 | 2/1965 | Hoegl | 96/1 |
| 3,275,684 | 9/1966 | Fritz et al. | 260/515 |
| 3,331,687 | 7/1967 | Kosche | 96/1.5 |
| 3,607,257 | 9/1971 | Johnson | 96/1.6 |
| 3,819,693 | 9/1974 | Levine et al. | 260/520 |
| 3,867,140 | 2/1975 | Hashimoto | 430/83 |
| 4,013,623 | 3/1977 | Turner et al. | 260/63 |
| 4,046,564 | 9/1977 | Turner | 96/1.5 |
| 4,047,949 | 9/1977 | Horgan | 96/1.5 |
| 4,115,116 | 9/1978 | Stoika et al. | 96/1.5 |
| 4,135,928 | 1/1979 | Hashimoto et al. | 96/1.5 |
| 4,218,247 | 8/1980 | Hara et al. | 430/83 |
| 4,315,981 | 2/1982 | Wiedemann et al. | 430/59 |

*Primary Examiner*—John E. Kittle
*Assistant Examiner*—John L. Goodrow
*Attorney, Agent, or Firm*—E. O. Palazzo

[57] ABSTRACT

An improved layered photoresponsive device comprised of a supporting substrate, a photogenerating layer, and in contact with the photogenerating layer an electron transporting layer comprised of compounds of the following formula:

wherein X and Y are cyano groups or alkoxycarbonyl groups A, B, and W are electron withdrawing groups independently selected from the group consisting of acyl, alkoxycarbonyl, nitro, alkylaminocarbonyl, and derivatives thereof, m is a number of from 0 to 2, and n is the number 0 or 1.

24 Claims, 3 Drawing Figures

LAYERED PHOTORESPONSIVE DEVICES

BACKGROUND OF THE INVENTION

Figure 1:
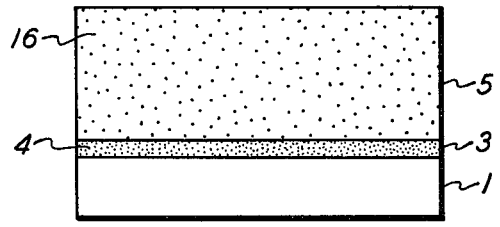

This invention is generally directed to improved overcoated layered photoresponsive devices, and more specifically, the present invention is directed to an improved layered photoresponsive device containing as electron transporting materials novel derivatives of fluorenylidene methane. In one specific embodiment of the present invention there is provided a layered photoresponsive device containing a photogenerating layer, and in contact therewith an electron transporting layer comprised of certain derivatives of 9-fluorenylidene methane compositions dispersed in an inactive resinous binder material. Additionally, the present invention includes within the scope thereof photoresponsive devices wherein the electron transporting layer selected has added thereto, or is doped with suitable electron donor molecules to improve the physical and/or electrical properties thereof. The improved photoresponsive devices of the present invention are useful for incorporation into various imaging systems, particularly electrostatographic imaging systems, wherein for example the device is initially charged positively.

The formation and development of electrostatic latent images on the imaging surfaces of photoconductive materials by electrostatic means is well known, one such method involving the formation of an electrostatic latent image on the surface of a photosensitive plate, referred to in the art as a photoreceptor. This photoreceptor is generally comprised of a conductive substrate containing on its surface a layer of photoconductive material, and in many instances a thin barrier layer is situated between the substrate and the photoconductive layer to prevent charge injection from the substrate, which injection could adversely affect the quality of the images generated.

Numerous different xerographic photoconductive members are known including, for example, a homogeneous layer of a single material, such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photocondutive inorganic compound dispersed in an electrically insulating organic resinous binder. In a commercial form the binder layer contains particles of zinc oxide uniformly dispersed in a resinous binder, and coated on a paper backing. The binder material as disclosed in this patent comprises a composition which is incapable of transporting for any significant distance injected charge carriers generated by the photoconductive particles. Illustrative examples of specific binder materials disclosed include for example polycarbonate resins, polyester resins, polyamide resins, and the like.

There are also known photoreceptor material comprised of other inorganic or organic materials wherein the charge carrier generation and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain high quality images. Additionally, photoresponsive devices are desired which can be charged positively, and contain therein an electron transporting material.

Recently, there has been disclosed layered photoresponsive devices comprised of photogenerating layers and transport layers as described in U.S. Pat. No. 4,265,990, and overcoated photoresponsive materials containing a hole injecting layer, in contact with a transport layer, an overcoating of a photogenerating layer, and a top coating of an insulating organic resin, reference, for example, U.S. Pat. No. 4,251,612. Examples of generating layers disclosed in these patents include trigonal selenium, and phthalocyanines, while examples of transport layers that may be used, which layers transport positive charges, in contrast to the transport layers of the present invention which transport electrons, include certain diamines dispersed in a resinous binder. The disclosure of each of these patents, namely U.S. Pat. Nos. 4,265,990 and 4,251,612 are totally incorporated herein by reference.

Many other patents are existence describing photoresponsive devices including layered devices containing generating substances such as U.S. Pat. No. 3,041,167, which discloses an overcoated imaging member containing a conductive substrate, a photoconductive layer, and an overcoating layer of an electrically insulating polymeric material. This member is utilized in an electrophotographic copying by, for example, initially charging the member with electrostatic charges of a first polarity, and imagewise exposing to form an electrostatic latent image, which can be subsequently developed to form a visible image. Prior to each succeeding imaging cycle, the imaging member can be charged with an electrostatic charge of a second polarity which is opposite in polarity to the first polarity. Sufficient additional charges of the second polarity are applied so as to create across the member a net electrical field of the second polarity. Simultaneously, mobile charges of the first polarity are created in the photoconductive layer by applying an electrical potential to the conductive substrate. The imaging potential which is developed to form the visible image is present across the photoconductive layer, and the overcoating layer.

Furthermore, there is disclosed in U.S. Pat. No. 4,135,928 electrophotographic light sensitive members containing 7-nitro-2-aza-9-fluorenylidene-malononitrile as a charge transporting substance. According to the disclosure of this patent, the electrophotographic light sensitive members contain an electroconductive support, a layer thereof comprising a charge generating substance, and 7-nitro-2-aza-9-fluorenylidene-malononitrile, of the formula, for example, as illustrated in column 1.

Other representative patents disclosing layered photoresponsive devices include U.S. Pat. Nos. 4,115,116, 4,047,949, and 4,315,981. There is disclosed in the '981 patent an electrophotographic recording member containing an organic double layer. According to the disclosure of this patent, the recording member consists of an electroconductive support material and a photoconductive layer of organic materials which contain a charge carrier producing dyestuff layer of a compound having an aromatic or heterocyclic polynuclear quinone ring system, and a transparent top layer of certain oxdiazoles. Apparently, this recording member is useful in electrophotographic copying processes where negative charging of the top layer occurs when an electron donating compound is selected for the device involved.

Many of the photoresponsive devices described, such as those disclosed in U.S. Pat. No. 4,265,990, contain a transport layer, the function of which is to transport positive charges generated by the photogenerating layer. In the imaging sequence, these devices are charged negatively thus necessitating the need for a charge carrier transport material which will allow the migration of positive charges. Similar devices containing electron transporting layers are relatively unknown.

Thus, while the above described photoresponsive devices are suitable for their intended purposes, there continues to be a need for improved devices, particularly layered devices which can be repeatedly used in a number of imaging cycles without deterioration thereof from the machine environment or surrounding conditions. Additionally, there continues to be a need for improved layered imaging members which contain electron transporting layers, thus allowing such devices to be positively charged. Moreover, there continues to be a need for improved photoresponsive devices which can be prepared with a minimum number of processing steps, and wherein the layers are sufficiently adhered to one another to allow the continuous use of these devices in repetitive imaging and printing systems. Furthermore, there continues to be a need for improved photoresponsive layered devices.

SUMMARY OF THE INVENTION

It is therefore an object of the present invention to provide an improved photoresponsive imaging device which overcomes the above-noted disadvantages.

It is yet anothr object of the present invention to provide an improved layered photoresponsive device containing novel electron transporting substances.

In a further object of the present invention, there is provided an overcoated layered photoresponsive device containing a photogenerating layer, and in contact therewith an electron transporting layer containing certain derivatives of 9-fluorenylidene methane dispersed in an inactive resinous binder composition.

In yet another object of the present invention, there is provided imaging methods with the improved photoresponsive imaging devices of the present invention.

In still another object of the present invention, there is provided a photoresponsive layered device containing a photogenerating layer, and in contact therewith a transport layer comprising electron transporting compositions in an inactive resinous binder doped with suitable electron donor molecules.

These and other objects of the present invention are accomplished by the provision of an improved photoresponsive device comprising a photogenerating layer and an electron transporting layer in contact therewith. More specifically, the present invention is directed to an improved photoresponsive device comprised of a supporting substrate, a photogenerating layer, and an electron transporting layer comprised of fluorenylidene derivatives of the following formula:

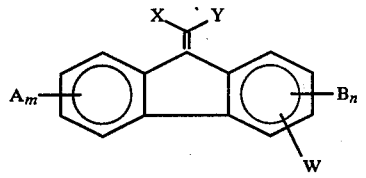

wherein X and Y are cyano groups, (CN) or alkoxycarbonyl groups (COOR) A, B, and W, are independently selected from electron withdrawing groups including acyl, alkoxycarbonyl, nitro, alkylaminocarbonyl, or derivatives thereof, m is a number of from 0 to about 2, and n is the number 0 or 1. Moreover, the X and Y groups can be selected from COR, COOR, or $CONR^1R^2$, wherein R is an alkyl group, a substituted alkyl group, substituted with alkoxy for example, an aryl group, or a carboxyclic group, and $R^1$ or $R^2$ are hydrogen, alkyl groups, or aryl groups. Additionally, in a specific embodiment of the present invention, the substituents A and B can be independently selected from alkyl groups.

Illustrative examples of acyl groups include those of the formula RCO, wherein R is an alkyl group, such as acetyl, propionyl, isovaleryl, anisoyl, stearoyl and the like, with isovaleryl being preferred.

Examples of alkoxycarbonyl groups, COOR, wherein R is an alkyl group, or derivative thereof, include methoxycarbonyl, ethoxycarbonyl, isopropoxycarbonyl, butoxycarbonyl, phenethoxycarbonyl, carbitoxycarbonyl, and the like, while illustrative examples of alkylaminocarbonyl substituents, or derivatives thereof include propylaminocarbonyl, butylaminocarbonyl, diethylaminocarbonyl, 2-methoxyethylaminocarbonyl, stearylaminocarbonyl, and the like.

Illustrative examples of alkyl groups, including alkyl groups for the electron withdrawing substituents A, and B, include those containing from 1 carbon atom to about 20 atoms, and preferably from 1 carbon atom to about 8 carbon atoms, such as methyl, ethyl, propyl, butyl, pentyl, hexyl, octyl, nonyl, decyl, pentadecyl, stearyl, and the like. Specific preferred alkyl groups include methyl, ethyl, propyl and butyl. Aryl substituents include those of from 6 to about 24 carbon atoms such as phenyl, and napthyl.

Examples of electron transporting materials embraced within the above general formula, and suitable for the electron transporting layers of the photoresponsive devices of the present invention include those compounds as represented by the following formulas:

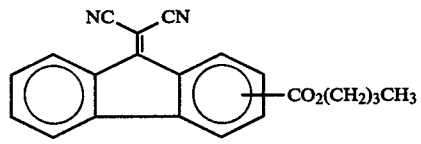

I

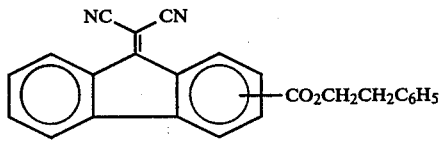

II

-continued

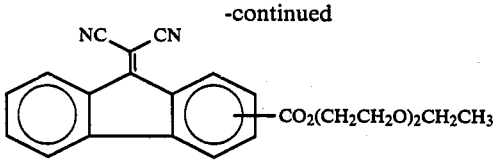

III

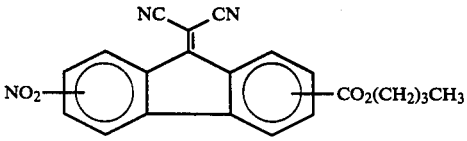

IV

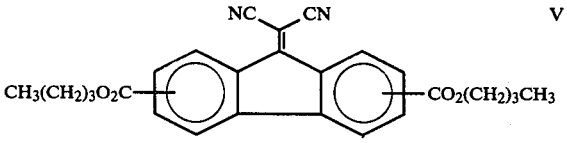

V

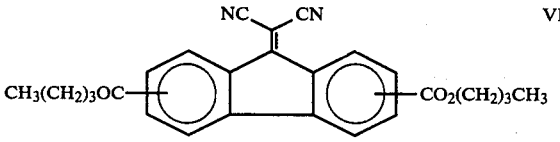

VI

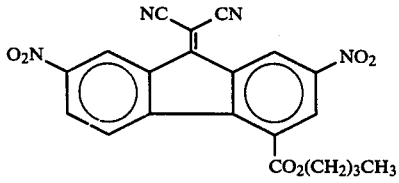

VII

-continued

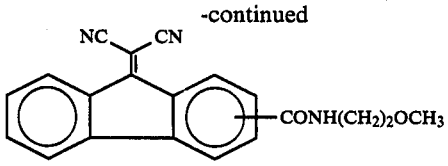

VIII

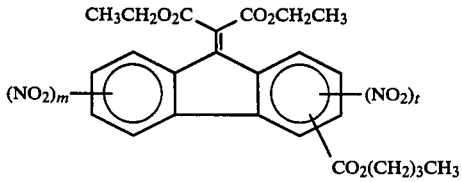

IX

WHERE m IS 1 OR 2, t IS ZERO OR 1.

The electron transporting compounds embraced within the present invention are synthesized from the respective functionalized fluorenone precursors, some of which are commercially available, or readily accessible synthetically. For example, the nitro- and dinitrofluorenone-carboxylic acid precursors are obtained by the controlled nitration of the corresponding fluorenone-carboxylic acids, while the precursors for compounds V, and VI, illustrated herein, can be obtained by Friedel Crafts acylation of fluorine, followed by appropriate oxidation, reference Journal Of Organic Chemistry, Vol. 35, page 2762, 1970, Journal of American Chemical Society, Vol. 80, page 549, 1958. The following reaction schemes illustrate the basic transformations by which the (alkoxycarbonyl-9-fluorenylidene)-malononitrile-based electron transporting compounds are obtained:

SCHEME 1

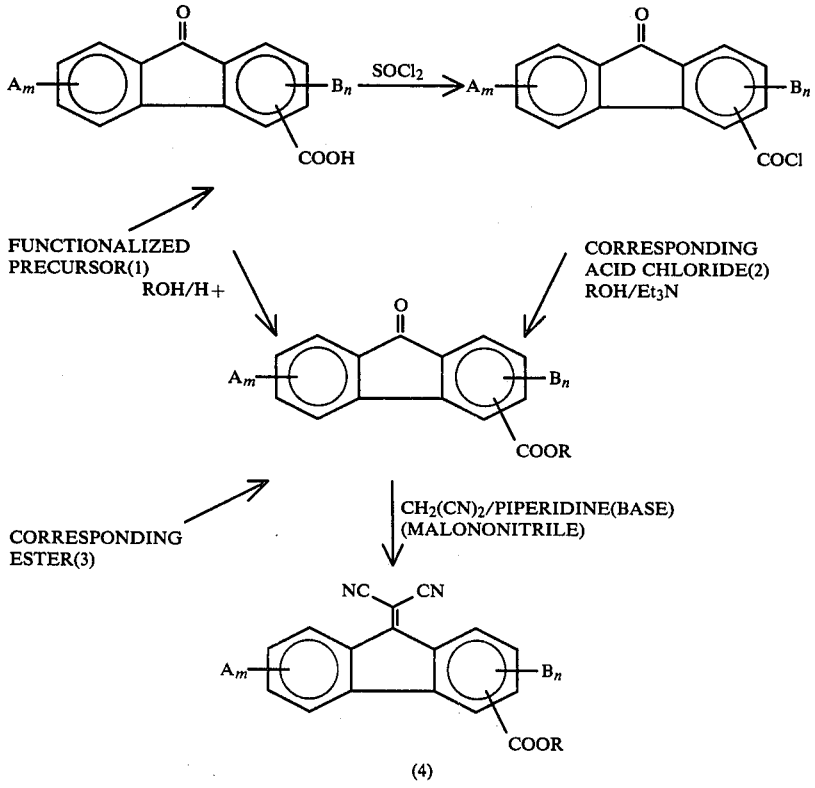

(4)

The corresponding alkylaminocarbonyl-substituted electron transporting compounds are prepared in a substantially identical manner as shown above with reference to reaction Scheme 1, with the exception that the corresponding acid chloride, (2), is reacted with the alkylamine $RNH_2$ resulting in the corresponding amide (3), containing the group CONHR, instead of COOR. The corresponding amide is then converted to the electron transporting alkylaminocarbonyl-substituted compound, represented by structure (4), with the exception that the COOR group, is replaced with the grouping CONHR.

SCHEME 2

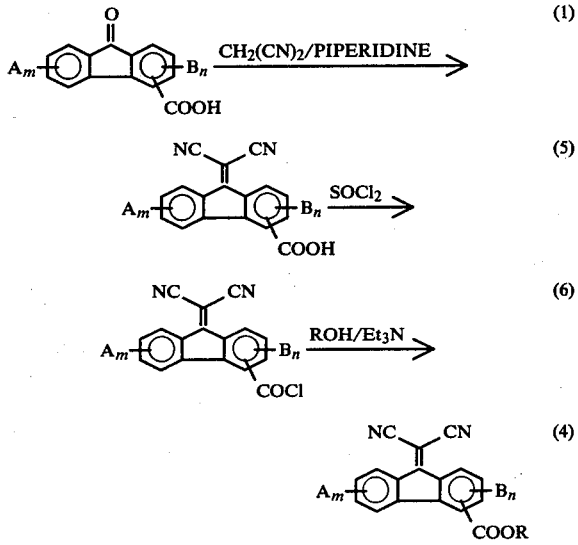

More specifically, the reaction sequences as illustrated above with reference to Scheme 1 and Scheme 2 involve the following process parameters.

The acid-catalysed esterification of the fluorenone-carboxylic acid derivative (1) to ester (3) can be achieved by refluxing this substance with a 10 to 30-fold molar excess of an alcohol, such as ethanol, or butanol, in a suitable solvent such as benzene, toluene, xylene and the like, in the presence of a catalytic amount of concentrated sulfuric acid or p-toluenesulfonic acid. The solvent should be capable of forming an azeotrope with water in order that water generated by the reaction can be removed azeotropically by means of a Dean-Stark apparatus. In general, the esterification is completed in from about 12 to 36 hours. Alternatively, the carboxylic acid can be first converted to the corresponding acid chloride (2) by refluxing in thionyl chloride (50–150 milliliters per 0.1 mole of carboxylic acid) for 1 to 5 hours, followed by treatment with a stoichiometric quantity, or any excess of an alcohol in the presence of a stoichiometric excess of triethylamine contained in a suitable dried solvent such as methylene chloride or tetrahydrofuran at room temperature. The carboxylic ester (3) obtained can generally be purified by simple recrystallization from a suitable solvent. Subsequent dicyanomethylenation of the fluorenone-carboxylate (3) is accomplished by refluxing with 1.5 to 3-fold excess of distilled malononitrile in absolute methanol in the presence of a catalytic amount of piperidine for 12 to 36 hours. The extent of the esterification and dicyanomethylenation reactions can be conveniently followed by thin layer chromatography, and the products can be identified by spectroscopic means, including IR, NMR and Mass spectometry.

The alternative reaction illustrated in Scheme 2 involves an initial dicyanomethylenation of fluorenone-carboxylic acid (1) to the corresponding dicyanomethylene compound (5). The dicyanomethylenation reaction is effected in the same manner as described herein for Scheme 1, except that a longer reaction time is required, about 24 to about 50 hours. The conversion of (5) to the corresponding acid chloride (6) can be accomplished by treatment with excess thionyl chloride under reflux conditions for 2 to about 10 hours. The acid chloride is purified by recrystallization from methylene chloride and hexane. Subsequent reaction with an alcohol to form the corresponding ester (4) is generally accomplished at room temperature in dried methylene chloride or tetrahydrofuran, in the presence of a stoichiometric excess of triethylamine. The amount of alcohol selected in the reaction can be a stoichiometric quantity to an excess. The reaction is generally completed in 1 to about 5 hours, and the products are identified as disclosed herein with reference to reaction Scheme 1.

Figure 2:
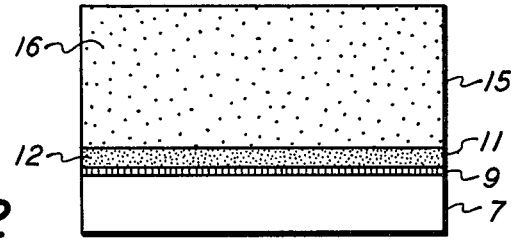
Figure 3:
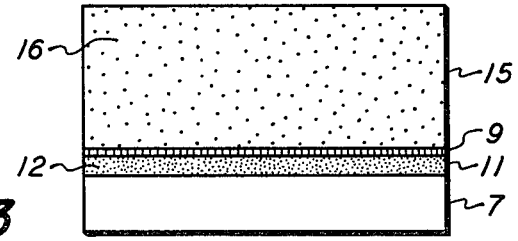

Photoresponsive devices containing the novel electron transporting compositions of the present invention are illustrated in FIGS. 1, 2, and 3. More specifically, there is illustrated in FIG. 1 a photoresponsive device containing a substrate 1, a photogenerating layer 3, optionally dispersed in an inactive resinous binder 4, and an electron transporting layer 5, containing the electron transporting compositions of the present invention, optionally dispersed in a resinous binder 16. Similarly, there is illustrated in FIG. 2 a photoresponsive device comprised of a substrate 7, an injection barrier layer 9, a photogenerating layer 11, containing photogenerating pigments optionally dispersed in an inactive resinous binder 12, and an electron transporting layer 15, comprised of the electron transporting compounds of the present invention, optionally dispersed in a resinous binder. Illustrated in FIG. 3 is a further modified photoresponsive device of the present invention substantially equivalent to the photoresponsive device described with regard to FIG. 2, with the exception that the photogenerating layer 11, is situated between the transport layer 7, and the injection barrier layer 9.

The photoresponsive devices disclosed are useful in electrostatographic imaging systems, particularly electrostatic imaging systems, wherein the devices are initially charged positively, followed by imagewise exposure of the device, development of the resulting latent image with a developer composition, comprised of toner resin particles, and carrier particles, followed by transferring the developed image to a suitable substrate, such as paper, and permanently affixing the image thereon.

With further reference to the photoresponsive devices, the substrate layers are of a thickness of from about 1 mil to about 50 mils, and may be comprised of any suitable material having the requisite mechanical properties. Thus, the substrate layers may comprise a layer of insulating material, such as an inorganic or organic polymeric material, or a conductive material such as, for example, aluminum, chromium, nickel, brass, or the like. The substrate may be flexible or rigid, and may be of a number of many different configurations, such as, for example, a plate, a cylindrical drum, a scroll, an endless flexible belt, and the like. Preferably, the substrate is in the form of an endless flexible belt.

The photogenerating layers can be comprised of known photoconductive charge carrier generating materials including, for example, amorphous selenium, amorphous selenium alloys, halogen-doped amorphous selenium, halogen-doped amorphous selenium alloys, trigonal selenium, selenide and carbonates with trigonal selenium, reference U.S. Pat. Nos. 4,232,102 and 4,233,283, cadmium sulfide, cadmium selenide, cadmium telluride, cadmium sulfur selenide, cadmium sulfur telluride, cadmium seleno telluride, copper and chlorine-doped cadmium sulfide, and the like. Alloys of selenium included within the scope of the present invention include selenium tellurium alloys, selenium arsenic alloys, selenium tellurium arsenic alloys, and preferably such alloys containing the halogen material, such as chlorine, in an amount of from about 50 to about 200 parts per million.

Other photogenerating layers include metal phthalocyanines, metal-free phthalocyanines, vanadyl phthalocyanines, other known phthalocyanines as disclosed in U.S. Pat. No. 3,816,118 the disclosure of which is totally incorporated herein by reference, squarilium pigments, and the like. Preferred photogenerating layers include trigonal selenium, squarilium pigments and vanadyl phthalocyanine.

The photogenerating layers are generally of a thickness of from about 0.05 microns to about 10 microns or more, and preferably are of a thickness of from about 0.4 microns to about 3 microns, however, the thickness of this layer is primarily dependent on the photoconductive volume loading, which may vary from 5 to 100 volume percent.

The photogenerating layer generally contains the above-described photogenerating pigments dispersed in an inactive resinous binder composition, in amounts of from about 5 percent by volume to about 95 percent by volume, and preferably in amounts of from about 25 percent by volume to about 75 percent by volume. Illustrative examples of polymeric binder resinous materials that can be selected include those as disclosed, for example, in U.S. Pat. No. 3,121,006, the disclosure of which is totally incorporated herein by reference, polyesters, polyvinylbutryl, polycarbonate resins, polyvinylcarbazole, epoxy resins, phenoxy resins, especially the commercially available poly(hydroxyether) resins, and the like.

The electron transporting layer ranges in thickness of from about 2 microns to about 100 microns, and preferably is of a thickness of from 5 microns to about 30 microns.

Also, the electron transporting material is generally dispersed in a highly insulating and transparent resinous material or inactive resinous binder material 16, including those as described in U.S. Pat. No. 3,121,006 the disclosure of which is totally incorporated herein by reference. Specific examples of resinous materials include polycarbonates, acrylate polymers, vinylpolymers, cellulose polymers, polyesters, polysiloxanes, polyamides, polyurethanes, and epoxies, as well as block random or alternating copolymers thereof. Preferred electrically inactive binder materials are polycarbonate resins having a molecular weight of from about 20,000 to about 100,000, with a molecular weight in the range of from about 50,000 to about 100,000 being particularly preferred. Generally, the resinous binder is present in the electron transporting layer in an amount of from about 25 percent by weight to about 90 percent by weight, and preferably from about 50 percent by weight to about 65 percent by weight. Other inactive resinous binder materials can be selected for the electron transporting layer providing the objectives of the present invention are achieved, including, for example, polyhydroxy ethers, such as those commercially available from Union Carbide, and the like.

Illustrative examples of injection barrier layers useful for the photoresponsive devices of the present invention include polysiloxanes, poly(vinylpyrrolidones), polyamides, polyurethanes, polyesters, nitrocellulose, poly(vinylidene chlorides), and the like, with poly(vinylpyrrolidones) being preferred. This layer is of a thickness of from about 0.05 microns to about 2 microns.

The electron transporting compounds of the present invention are synthesized, and easily purified, and further, these compositions desirably do not form, or form only very weak charge transfer complexes with donor molecules. Additionally, the electron transporting compositions of the present invention are non-mutagenic, and are substantially desirably transparent to visible light.

The invention will now be described in detail with respect to specific preferred embodiments thereof, it being understood that these examples are intended to be illustrative only and the invention is not intended to be limited to the materials, conditions or process parameters recited herein. All percentages and parts are by weight unless otherwise indicated.

EXAMPLE I

Preparation of (4-n-Butoxycarbonyl-9-fluorenylidene)malononitrile (I)

In a 5,000-millileter, round-bottomed flask equipped with a Dean-Stark apparatus and a water condenser, were placed 100 grams (0.446 mole) of fluorenone-4-carboxylic acid, available from Aldrich Chemicals, 650 grams of n-butanol, 5 milliliters of concentrated sulfuric acid, and 2,000 milliliters of toluene. The mixture was magnetically stirred and heated under reflux for 24 hours. The mixture was then cooled to room temperature, and the n-butanol solvent was evaporated under reduced pressure in the presence of 10 grams of sodium bicarbonate. Subsequently, 1,000 milliters of methylene chloride was added to the residue, and the resulting solution was washed twice with dilute aqueous sodium bicarbonate solution, and twice with water. After drying with anhydrous magnesium sulfate, the solution was filtered and evaporated under reduced pressure, resulting in 120 grams of n-butyl fluorenone-4-carboxylate ester.

The resulting ester, 120 grams, was then placed in a 2,000 milliliter round-bottomed flask. To this was added 1,000 milliliters of absolute methanol, 59 grams (0.89 mole) of malononitrile, and 25 drops of piperidine. The mixture was stirred magnetically, and heated under reflux for 20 hours. The solid product from the cooled reaction mixture was filtered, washed twice with 100 milliliters of methanol, once with 200 milliliters of water, and dried under vacuum at 50° C. for 10 hours. The resulting product was then recrystallized from acetone and methanol, yielding 123 grams of pure (4-n-butoxycarbonyl-9-fluorenylidene)malononitrile melting point 99°–100° C.

| Analytical Calculation for $C_{21}H_{16}N_2O_2$ | |
|---|---|
| Calculated | Found |
| C, 76.81 | C, 76.52 |
| H, 4.91 | H, 5.04 |
| N, 8.53 | N, 8.28 |

The compound was further identified by spectroscopic means, with the following results:

NMR ($CDCl_3$), delta: 1.0 (t, 3H); 1.5 (m, 2H); 1.8 (m, 2H); 4.5 (t, 2H); 7.3–8.7.t (m, 7H).

IR (KBr pellet): 2240 $cm^{-1}$(CN); 1730 $cm^{-1}$(C=O).

EXAMPLE II

A photoresponsive device containing as the transport layer the compound as prepared in Example I, 50 percent by weight, dispersed in poly(N- vinylcarbazole), (PVK), and amorphous selenium as the generator was prepared as follows:

A 1-micron thick layer of amorphous selenium was vacuum evaporated on a ball grained aluminum substrate, of a thickness of 7 mils, by known conventional vacuum deposition techniques. Vacuum deposition was accomplished at a vacuum of $10^{-6}$ Torr, while the substrate was maintained at a temperature of about 50° C. A 18 micron thick transport layer comprising 50% of the compound as prepared in Example I and 50% by weight of PVK was coated over the amorphous selenium layer with a Bird applicator. The solution for the transport layer was prepared by dissolving 5 grams of the compound as prepared in Example I and 5 grams of PVK in 70 grams of methylene chloride. This solution was then coated over the amorphous selenium layer with the Bird Film applicator. The resulting device was then dried at 50° C. for 12 hours to form a 18 micron thick dry transport layer. Subsequent, to cooling, this device was electrically tested by positively charging to fields of 45 volts/micron and discharging using white light of wavelengths of 400–700 nanometer (nm). The half decay exposure sensitivity of this device was about 80 ergs/$cm^2$.

EXAMPLE III

A photoresponsive layered device containing the compound as prepared in Example I, dispersed in polycarbonate as the transport layer, and trigonal selenium in PVK as the generator, was prepared as follows:

A 2-micron thick photogenerating layer comprising trigonal selenium, N,N'-diphenyl-N,N'-bis(3-methylphenyl)-[1,1'-biphenyl]-4,4'-diamine, (U.S. Pat. No. 4,265,990) in PVK was prepared by coating a dispersion of these materials in tetrahydrofurane (THF)/toluene over an aluminized Mylar substrate, of a thickness of 3 mils with a Bird Film applicator, and dried in a forced air oven at 135° C. for 5 minutes. The dispersion was prepared by ball milling 0.8 grams of trigonal selenium, and 0.8 grams of PVK in 7 milliliters each of THF and toluene, followed by diluting with 5.0 grams of the resulting slurry with a solution of 0.12 grams of the diamine in 2.5 milliliters each of THF and toluene.

A charge transport solution prepared from 1.0 grams of the compound as prepared in Example I, and 1.0 grams of Makrolon polycarbonated dispersed in 20 milliliters of methylene chloride was then coated on top of the photogenerating layer in accordance with the procedure of Example II. The resulting device was then dried in a forced air oven at 130° C. for 30 minutes and a 14 micron thick dry transport layer was obtained. Subsequently, the device was cooled to room temperature and tested electrically by charging positively to fields of 50 volts/micron and discharging using white light of wavelengths of 400–700 nm. The half decay exposure sensitivity of this device is 18 ergs/$cm^2$.

EXAMPLE IV

A photoresponsive layered device containing the compound (I) as prepared in Example I, as a transport molecule, and squarilium pigments as a generator layer, was prepared as follows:

A ball grained aluminum substrate was coated with a solution of 2 milliliters of 3-aminopropyltrimethoxysilane in 4 milliliters of methylene chloride, resulting in a 0.1 micron thick polysilane layer, subsequent to heating at 110° C. for 10 minutes. A dispersion of photogenerator layer obtained from ball milling a mixture of 0.075 grams of bis(N,N-dimethylaminophenyl)- squaraine and 0.13 grams of Vitel PE-200 polyester (Goodyear) in 12 ml of methylene chloride for 24 hours was coated on top of the polysilane layer. After drying in a forced air oven at 135° C. for 6 minutes, a 1 micron thick squarilium photogenerating layer was obtained.

The solution for the transport layer was prepared by dissolving 1.0 gram of Compound (I), 0.3 grams of N,N'-diphenyl-N,N'-bis(3-methylphenyl)-[1,1-biphenyl]-4,4'-diamine, and 1.0 grams of Makrolon in 20 milliliters of methylene chloride. This solution was then coated by means of a Bird Film applicator over the generator layer resulting in a 17 micron thick transport layer, after drying in a forced air oven at 135° C. for 30 minutes. The resulting device was cooled to room temperature and tested electrically by positively charging to fields of 40 volts/micron and discharging with 830 nm monochromatic light. The half decay exposure sensitivity of this device was 7 ergs/$cm^2$.

EXAMPLE V

The following example illustrates a photoresponsive layered device with a relatively thin transport layer.

There was prepared a photoresponsive device containing a trigonal selenium photogenerating layer in a thickness of 2 microns, on aluminized Mylar, by repeating the procedure of Example III. The transport layer solution composition of Example IV was coated on the photogenerating layer in a forced air oven at 135° C. for 30 minutes, resulting in a thickness for this layer of 5 microns. The resulting device was then electrically tested in accordance with the process as described in Example IV, with the exception that the device was positively charged to fields of 80 volts/micron, followed by discharging the device with 400–700 nm white light. The half decay exposure sensitivity of this device was 10 ergs/$cm^2$.

EXAMPLE VI

Preparation of (4-Phenethoxycarbonyl-9-fluorenylidene)malononitrile (II).

(a) Preparation of precursor (4-carboxy-9-fluorenylidene)malononitrile: A mixture of 93.1 grams (0.415 mole) of fluorenone-4-carboxylic acid and 750 milliliters of absolute methanol was magnetically stirred and heated to reflux temperature in a 2,000 milliliters round-bottomed flask fitted with a reflux condensor. Subsequently, there was added to the flask 82.3 grams (1.25 mole) of malononitrile and 20 drops of piperidine. This mixture was then heated under reflux for 48 hours.

The solid product (4-carboxy-9-fluorenylidene)-malononitrile, was collected by suction filtration, and purified by stirring in 500 milliliters of boiling methanol for 15 minutes, followed by filtration and washing successively with 200 milliliters of methanol. The product was dried under vacuum at 65° C. for 12 hours and weighed 90.1 grams.

(b) Preparation of (4-chloroformyl-9-fluorenylidene)-malononitrile: A mixture of 27.44 grams (0.10 mole) of (4-carboxy-9-fluorenylidene)malononitrile as obtained above, and 150 milliliters of thionyl chloride in a 250 milliliter round-bottomed flask equipped with a reflux condenser was magnetically stirred and heated under reflux in a dry nitrogen atmosphere for 6 hours. The solid acid dissolved after 1 hour's heating. As the reaction proceeded, the reaction mixture turned brownish in color and became dark brown. The reaction mixture was then evaporated at reduced pressure resulting in a solid residue, and 300 milliliters of dichloroethane was added to this crude product. Evaporation under reduced pressure was continued to remove traces of thionyl chloride. The crude product was recrystallized from methylene chloride/hexane (350 ml/400 ml). The pure (4-chloroformyl-9-fluorenylidene)-malononitrile obtained weighed 27.99 grams after drying under vacuum at 40° C. for 12 hours.

(c) Preparation of Compound (II): 8.5 grams (0.03 mole) of (4-chloroformyl-9-fluorenylidene)malononitrile was dissolved in 150 milliliters of dried methylene chloride in a 250 milliliter round-bottomed flask under a dry nitrogen atmosphere. The solution was magnetically stirred at room temperature. A solution of 3.67 grams (0.03 mole) of phenethyl alcohol and 4.5 milliliters of triethylamine in 30 milliliters of methylene chloride was added dropwise by means of a pressure-equalizing dropping funnel over a period of 10 minutes. After the addition, the reaction mixture was allowed to react at room temperature for 4 hours. The mixture was poured into a 500 milliliter separatory funnel and washed with dilute aqueous sodium bicarbonate solution (3 times) and then water (2 times), dried with anhydrous magnesium sulfate, and filtered. The filtrate was evaporated at reduced pressure to give crude Compound (II) which was recrystallized from methylene chloride/hexane. The yield of pure product was 8.3 grams. The melting point was 115°–17° C.

Analytical calculation for $C_{25}H_{16}N_2O_2$: C, 79.77; H, 4,28; N, 7.44. Found: C, 79.82; H, 4.41; N, 7.42.

NMR ($CDCl_3$), delta: 3:15 (t, 2H); 4.65 (t, 2H); 7.2–8.6 (m, 12H).

IR (KBr pellet): 2240 cm $^{31}$ $^{1}$(CN); 1735 cm $^{-1}$(C=O).

EXAMPLE VII

Preparation of (4-Carbitoxy-9-fluorenylidene)-malononitrile (III).

A solution of 4.0 grams (0.0138 mole) of (4-chloroformyl-9-fluorenylidene) as obtained in Example II(b) in 75 milliliters of methylene chloride was magnetically stirred in a 200 milliliter round-bottomed flask under a dry nitrogen atmosphere. 2.1 milliliters (0.0152 mole) of 2-(2-ethoxyethoxy)-ethanol (carbitol) was added, this was followed by the addition of a solution of 2.1 milliliters of triethylamine in 5 milliliters of methylene chloride over a period of 3 minutes. The reaction mixture became cloudy due to the formation of triethylammonium chloride. The resulting mixture was allowed to react at room temperature for 4 hours. The reaction mixture was then treated in accordance with Example II(c). The yield of pure Compound (III) was 4.08 grams. The melting point was 75.5°–76° C.

Analytical calculation for $C_{23}H_{20}N_2O_4$: C, 71.12; H, 5.19; N, 7.21. Found: C,71.01; H, 5.21; N, 7.21.

NMR ($CDCl_3$), delta: 1.2 (t, 3H); 3.4–4.0 (m, 8H); 4.6 (t, 2H); 7.2–8.6 (m, 7H).

IR (KBr pellet): 2240 cm$^{31}$ $^{1}$(CN); 1730 cm $^{-1}$(C=O).

EXAMPLE VIII

A photoresponsive layered device containing Compound (II) was prepared as follows:

A 1-micron thick trigonal selenium generator layer on aluminized Mylar, thickness of 3 mils, similar to that of Example III was prepared, followed by coating with a solution of 1.2 grams of Compound (II) as prepared in Example VI, 1.0 grams of poly(carbonate bis-phenol A) (from Polysciences) and 0.3 grams of biphenyl-4,4'-diamine in 20 milliliters of methylene chloride using a Bird Film applicator. The coating was subject to drying in a forced air oven at 135° C. for 30 minutes and then cooled to room temperature yielding a 17 micron thick transport layer. The device was subject to electrical testing by positively charging to fields of 50 volts/micron and discharging with 400–700 nm white light, the half decay exposure sensitivity of this device was 32 ergs/cm$^2$.

EXAMPLE IX

A photoresponsive layered device using Compound (III) as transport molecule was fabricated by the following procedure:

A solution for the transport layer was prepared by dissolving 1.2 grams of Compound (III) and 1.0 grams of Makrolon polycarbonate in 20 milliliters of methylene chloride. This solution was then coated on a 2 micron thick trigonal selenium photogenerating layer deposited on aluminized Mylar, of a thickness of 3 mils and dried to a thickness of 14 microns. The device was positively charged to fields of 45 volts/micron and discharged with white light in accordance with Example VIII. The half decay exposure sensitivity of this device was 30 ergs/cm$^2$.

EXAMPLE X

Preparation of (4-n-butoxycarbonyl-2,7-dinitro-9-fluorenylidene)malonate (IX):

11.2 grams (0.05 mole) of fluorenone-4-carboxylic acid was placed in a 500-milliliter round-bottomed flask. There was then added to the flask 300 milliliters of red fuming nitric acid over a period of 10 minutes, which addition was effected at room temperature. This was followed by the addition of 50 milliliters of concentrated sulfuric acid over a period of 5 minutes. The resulting solution was stirred at room temperature for 10 minutes and then poured slowly into 1.5 liters of ice-cold water with constant swirling. The solid product, 2,7-dinitrofluorenone-4-carboxylic acid, was collected by suction filtration, washed with 100 milliliters of 5 percent aqueous hydrochloric acid solution, and dried in a vacuo at 60° C. for 24 hours. The dry weight of 2,7-dinitrofluorenone-4-carboxylic acid was 13.3 grams.

The conversion of 2,7-dinitrofluorenone-4-carboxylic acid (9.42 grams about 0.03 mole) into the corresponding n-butyl ester was effected in accordance with the procedure of Example I. The ester was purified by recrystallization from methylene chloride and hexane and the yield was 7 grams.

In a 200-milliliter round-bottomed flask, there was then placed 4 grams (0.011 mole) of the n-butyl 2,7-dinitrofluornenone-4-carboxylate, 2.5 milliliters (0.016 mole) of distilled diethyl malonate and 25 milliliters of methylene chloride. The solution was stirred magnetically and cooled with an ice-bath under a dry nitrogen atmosphere. To this solution was added 7 milliliters (0.065 mole) of titanium tetrachloride over a period of 5 minutes, followed by the addition of 10.4 milliliters (0.13 mole) of pyridine. The reaction mixture was then stirred at room temperature for 2 hours before being treated with 125 milliliters of water. The organic layer was separated in a separatory funnel, washed with 5 percent aqueous sodium bicarbonate solution and then with water. The organic solution was dried and evaporated to give the crude product which was recrystallized from isopropanol. The yield of (4-n-butoxycarbonyl-2,7-dinitro-9-fluorenylidene)malonate was 4.6 grams, m.p., 116.5°–17° C.

Analytical calculation for $C_{25}H_{24}N_2O_{10}$: C, 58.59; H, 4.72; N, 5.46.

Found: C, 58.57; H, 4.90; N, 5.35.

NMR ($CDCl_3$), delta: 1.0–2.0 (m, 13H); 4.3–4.9 (m, 6H); 8.2–9.0 (m, 5H).

IR (KBr pellet): 1735 $cm^{-1}$(C=O); 1540 $cm^{-1}$($C-NO_2$).

EXAMPLE XI

A photoresponsive device containing (4-n-butoxycarbonyl-2,7-dinitro-9-fluorenylidene)malonate (IX) as the electron transporting molecule was prepared as follows:

A 2-micron thick layer of the photogenerator of Example III was prepared on an aluminized Mylar substrate, thickness of 3 mils. An electron transporting layer similar to that of Example IV was prepared with the above Compound IX instead of (4-n-butoxycarbonyl-9-fluorenylidene)malononitrile (I). The device was positively charged to fields of 50 volts per micron and was satisfactorily discharged using white light of 400–700 nm, and the device had a half decay exposure sensitivity of 8 ergs/$cm^2$.

EXAMPLE XII

A photoresponsive device containing Compound (I) as prepared in Example I, as the transport molecule and trigonal selenium in PVK as the generator layer, was prepared as follows:

There was prepared a photoresponsive device containing a trigonal selenium photogenerating layer in a thickness of 2 microns on aluminized Mylar, thickness of 3 mils, by repeating the procedure of Example III. The transport layer solution composition of Example IV was coated on the photogenerating layer and dried in a forced air oven at 135° C. for 30 minutes, resulting in a thickness for this layer of 19 microns. The resulting device was then electrically tested in accordance with the process as described in Example III with the exception that the device was positively charged to fields of 42 volts/micron. The device exhibited satisfactory discharge characteristics in that it had a half decay exposure sensitivity of 8 ergs/$cm^2$.

EXAMPLE XIII

A photoresponsive device was prepared in accordance with the process as described in Example XII with the exceptions that the binder polymer for the transport layer was Merlon polycarbonate and the solvent, for the transport layer coating solution, was THF. The resulting device was then electrically tested in accordance with the process as described in Example XII. The device exhibited satisfactory discharged characteristics, in that it had a half decay exposure sensitivity of 70 ergs/$cm^2$.

EXAMPLE XIV

A photoresponsive layered device containing the compound (I) as prepared in Example I, as a transport molecule and phthalocyanine pigments as the generator layer, was prepared as follows:

A dispersion of a photogenerating layer obtained from ball milling a mixture of 0.234 grams of vanadyl phthalocyanine and 0.541 grams of 49000 polyester resin (DuPont) in 10 ml of methylene chloride for 3 hours was coated on top of a ball grained aluminum substrate. After drying in a vacuum oven at 55° C. for 16 hours, a 2-micron thick phthalocyanine photogenerating layer was obtained. The transport layer solution composition of Example IV was coated on the photogenerating layer and dried in a vacuum oven at 40° C. for 16 hours, resulting in a thickness for this layer of 16 microns. The resulting device was then electrically tested in accordance with the process as described in Example III with the exception that the device was positively charged to fields of 47 volts/micron. The device exhibited satisfactory discharge characteristics in that it had a half decay exposure sensitivity of 60 ergs/$cm^2$.

EXAMPLE XV

A photoresponsive layered device containing Compound (III) as a transport molecule was fabricated by the following procedure:

A trigonal selenium photogenerating layer in a thickness of 2 microns was prepared by repeating the procedure of Example III. A transport layer solution was prepared by dissolving 1.2 grams of compound (III) and 1.0 grams of polymethyl methacrylate available from Scientific Polymer Products in 15 ml of chloroform. This solution was coated by means of a Bird film applicator over the photogenerating layer resulting in a 14-micron thick transport layer, after drying in a forced air oven at 130° C. for 30 minutes. The resulting device was then electrically tested by repeating the procedure as described in Example III with the exception that the device was positively charged to fields of 40 volts/micron. The device exhibited satisfactory discharge characteristics, in that it had a half decay sensitivity of 35 ergs/$cm^2$.

Although the invention has been described with reference to specific preferred embodiments, it is not intended to be limited thereto but rather those skilled in the art will recognize variations and modification may be made therein which are within the spirit of the invention and within the scope of the following claims.

We claim:

1. An improved layered photoresponsive device comprised of a supporting substrate, a photogenerating layer, and in contact with the photogenerating layer an electron transporting layer comprised of compounds of the following formula:

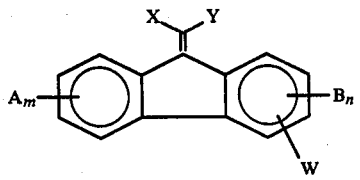

wherein X and Y are cyano groups or alkoxycarbonyl groups A, B, and W are electron withdrawing groups independently selected from the group consisting of acyl, alkoxycarbonyl, nitro and, alkylaminocarbonyl, m is a number of from 0 to 2, and n is the number 0 or 1.

2. An improved layered photoresponsive device in accordance with claim 1 wherein X and Y are selected from the groups COR, COOR, or $CONR^1R^2$, wherein R is an alkyl group, an alkyl group substituted with alkoxy, an aryl group, or carboxcylic group, wherein $R^1$ and $R^2$ are hydrogen, alkyl, or aryl.

3. An improved photoresponsive device in accordance with claim 2 wherein the alkyl group contains from about 1 to about 20 carbon atoms, and the aryl group is phenyl.

4. An improved photoresponsive device in accordance with claim 1 wherein A, B, and W are nitro.

5. An improved photoresponsive device in accordance with claim 1 wherein A, B, and W, are independently selected from acyl of the formula RCO, or alkoxycarbonyl of the formula COOR, wherein R is an alkyl group of from 1 carbon atom to about 20 carbon atoms.

6. An improved photoresponsive device in accordance with claim 5 wherein acyl is acetyl, propionyl, isovaleryl, anisoyl, or stearoyl.

7. An improved photoresponsive device in accordance with claim 1 wherein the alkoxycarbonyl is methoxycarbonyl, ethoxycarbonyl, isopropoxylcarbonyl, butoxycarbonyl, or phenethoxycarbonyl.

8. An improved photoresponsive device in accordance with claim 1 wherein the electron transporting material is of the formula:

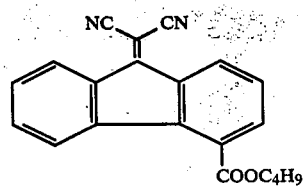

9. An improved photoresponsive device in accordance with claim 1 wherein the electron transporting material is of the formula:

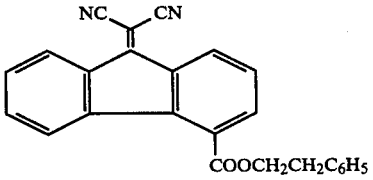

10. An improved photoresponsive device in accordance with claim 1 wherein the electron transporting material is of the formula:

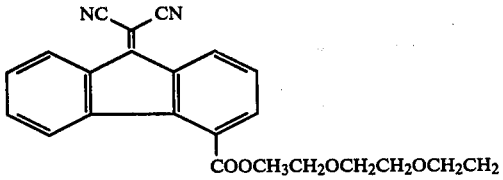

11. An improved photoresponsive device in accordance with claim 1 wherein the electron transporting material is of the formula:

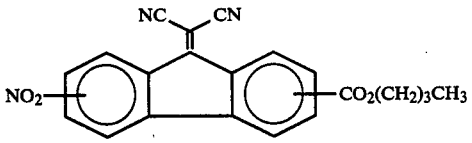

IV

12. An improved photoresponsive device in accordance with claim 1 wherein the electron transporting material is of the formula:

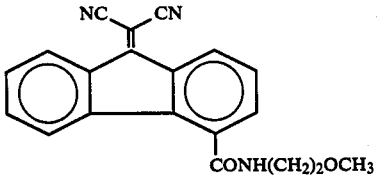

VIII

13. An improved photoresponsive device in accordance with claim 1 wherein the electron transporting material is of the formula:

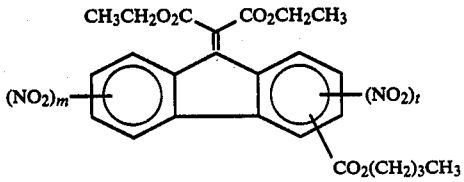

IX where m is 1 or 2, t is zero or 1.

14. An improved photoresponsive device in accordance with claim 1 wherein the electron transporting material is of the formula:

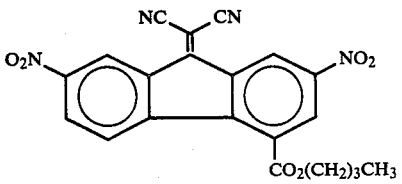

VII

15. An improved photoresponsive device in accordance with claim 1 wherein the electron transporting material is of the formula:

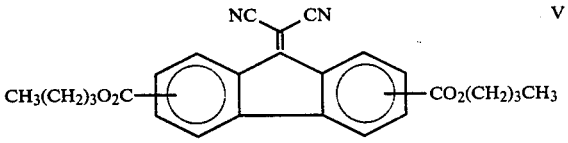

V

16. An improved photoresponsive device in accordance with claim 1 wherein the electron transporting material is of the formula:

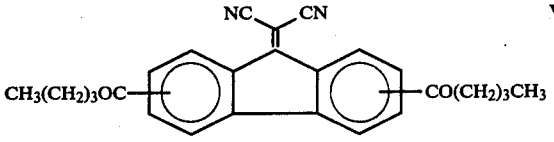

VI

17. An improved photoresponsive device in accordance with claim 1 wherein the photogenerating layer is comprised of selenium, selenium alloys, squarilium pigments, metal phthalocyanines metal-free phthalocyanines, or vanadyl phthalocyanines.

18. An improved photoresponsive device in accordance with claim 1 wherein the photogenerating layer is comprised of trigonal selenium.

19. An improved photoresponsive device in accordance with claim 1 wherein the electron transporting layer is of a thickness of from about 2 microns to about 100 microns, and the photogenerating layer ranges in thickness of from about 0.05 microns to about 20 microns.

20. An improved photoresponsive device in accordance with claim 1 wherein the electron transporting compounds or the photogenerating composition are dispersed in an inactive resinous binder composition.

21. An improved photoresponsive device in accordance with claim 20 wherein the resinous binder is a polyester, a polycarbonate, an epoxy, polyamide, polysiloxane, or vinyl polymer.

22. An improved photoresponsive device in accordance with claim 21 wherein the electron transporting molecule is present in an an amount of about 10 percent by weight to about 75 percent by weight, and the resinous binder is present in an amount of about 25 percent by weight to about 90 percent by weight.

23. An improved photoresponsive device in accordance with claim 21 wherein the photogenerating composition is present in an amount of from about 10 percent by weight to about 100 percent by weight, and the resinous binder is present in an amount of from about zero percent by weight to about 90 percent by weight.

24. An improved photoresponsive device in accordance with claim 1 wherein the electron transporting layer is optionally doped with electron donor materials in concentrations of from about 1 percent to about 30 percent by weight.

* * * * *